US011124921B2

(12) United States Patent
Satake Neto et al.

(10) Patent No.: US 11,124,921 B2
(45) **Date of Patent: *Sep. 21, 2021**

(54) TISSUE PRODUCTS HAVING MACROFOLDS

(71) Applicant: Kimberly-Clark Worldwide, Inc., Neenah, WI (US)

(72) Inventors: Tsutama Satake Neto, Sao Paolo (BR); Jorge Alonso Duran, Sao Paolo (BR); Patricia Camara Mileo, Sao Paolo (BR); Alessandro Lopes, Sao Paolo (BR); Marcelo Logiodice Cardoso, Sao Paolo (BR)

( * ) Notice: Subject to any disclaimer, the term of this patent is extended or adjusted under 35 U.S.C. 154(b) by 0 days.

This patent is subject to a terminal disclaimer.

(21) Appl. No.: 16/955,635

(22) PCT Filed: Aug. 29, 2019

(86) PCT No.: PCT/US2019/048686

§ 371 (c)(1),
(2) Date: Jun. 18, 2020

(87) PCT Pub. No.: WO2021/040710

PCT Pub. Date: Mar. 4, 2021

(65) Prior Publication Data

US 2021/0062431 A1 Mar. 4, 2021

(51) Int. Cl.

| | |
|---|---|
| ***D21H 27/40*** | (2006.01) |
| ***D21F 11/00*** | (2006.01) |
| ***D21H 27/00*** | (2006.01) |

(52) U.S. Cl.

CPC ..... *D21H 27/40* (2013.01); *D21F 11/006* (2013.01); *D21H 27/002* (2013.01)

(58) Field of Classification Search

USPC ..... 162/113

See application file for complete search history.

(56) References Cited

U.S. PATENT DOCUMENTS

| | | | | |
|---|---|---|---|---|
| 3,940,529 | A | 2/1976 | Hepford et al. | |
| 4,100,017 | A | 7/1978 | Flautt | |
| 4,469,735 | A * | 9/1984 | Trokhan | A47L 13/16 428/154 |
| 5,814,190 | A * | 9/1998 | Van Phan | B29C 39/18 162/109 |
| 5,865,824 | A * | 2/1999 | Chen | A61F 13/53747 604/378 |
| 5,894,046 | A | 4/1999 | Kim et al. | |
| 5,980,673 | A * | 11/1999 | Takeuchi | A47K 10/16 156/183 |
| 6,060,149 | A * | 5/2000 | Nissing | B32B 29/02 428/138 |
| 6,146,496 | A * | 11/2000 | Phan | D21F 11/006 162/113 |
| 6,153,037 | A | 11/2000 | Kim et al. | |
| 6,200,419 | B1 * | 3/2001 | Phan | B29C 39/18 162/109 |
| 6,458,447 | B1 | 10/2002 | Cabell et al. | |
| 6,913,673 | B2 | 7/2005 | Baggot et al. | |
| 7,611,607 | B2 | 11/2009 | Mullally et al. | |
| 7,846,531 | B2 * | 12/2010 | Basler | B31F 1/07 428/154 |
| 8,409,404 | B2 | 4/2013 | Harper et al. | |
| 2003/0121628 | A1 | 7/2003 | Mills et al. | |
| 2015/0053349 | A1 | 2/2015 | Mori et al. | |
| 2016/0002861 | A1 | 1/2016 | Goulet et al. | |

FOREIGN PATENT DOCUMENTS

| | | | |
|---|---|---|---|
| CN | 2855726 | Y | 1/2007 |
| CN | 109259640 | A | 1/2019 |
| GB | 253979 | A | 6/1926 |
| GB | 928462 | A | 6/1963 |
| WO | 17165919 | A1 | 10/2017 |

OTHER PUBLICATIONS

Cottonelle, "Cottonelle CleanCare Toilet Ripple Paper", https://www.amazon.com/Cottonelle-CleanCare-Toilet-Paper-Tissue/dp/B01AFRSPZY.

Make How, "Corrugated Cardboard", Jul. 12, 2018, http://www.madehow.com/Volume-1/Corrugated-Cardboard.html.

Co-Pending U.S. Appl. No. 16/955,651, filed Jun. 18, 2020, by Neto et al. for "Tissue Products Having Macrofolds".

CN2855726Y Certified Translation—reference previously cited in IDS filed Aug. 11, 2020.

CN2855726Y Certificate Certifying Translation, Apr. 2021.

* cited by examiner

*Primary Examiner* — Mark Halpern

(74) *Attorney, Agent, or Firm* — Kimberly-Clark Worldwide, Inc.

(57) ABSTRACT

The present invention provides multi-ply tissue products having distinctly different first and second outer surfaces or sides. The two-sidedness is generally provided by forming one of the surfaces from a tissue ply having a plurality of macrofolds and the other side from a substantially planar tissue ply. The first ply may be attached to the second ply at transversely spaced apart points by a conventional means, such as crimping. Macrofolds, which may be differently sized and shaped, may generally have a wave-like structure with a transversely orientated void that extends between the spaced apart points of attachment. The combination of these elements provides a tissue product that is both aesthetically pleasing and well suited to cleaning due to the large amount of surface area created by the macrofolds.

10 Claims, 3 Drawing Sheets

TISSUE PRODUCTS HAVING MACROFOLDS

BACKGROUND

Products made from paper webs such as bath tissues, facial tissues, paper towels, industrial wipers, food service wipers, napkins, medical pads and other similar products are designed to include several important properties. For example, for most applications, the product should be highly absorbent. In addition, products often should include surface texture in order to provide, for example, a good wiping surface in the case of wiping products or a soft surface texture in products which may be used while in contact with skin. Moreover, absorbent paper products which are multi-ply laminated products should avoid delamination under conditions of use.

Methods for increasing texture at the surface of a paper product are well known in the art. One well-known method is embossing, wherein the fibers in the web are mechanically deformed under high mechanical pressure to impart kinks and microcompressions in the fibers that remain substantially permanent while the web is dry. When wetted, however, the fibers may swell and straighten as the local stresses associated with the kinks or microcompressions in the fiber relax. Thus, embossed tissue when wetted tends to lose much of the added surface texture imparted by embossing and tends to collapse back to a relatively flat state. Similar considerations apply to the fine texture imparted to tissue by creping or microstraining, for such texture is generally due to local kinks and microcompressions in the fibers that may be relaxed when the tissue is wetted, causing the tissue to collapse toward a flatter state than it was in while dry.

Thus, there is a need for a method of converting a dry tissue web or other porous web into a structure having enhanced texture and physical properties. Moreover, there is a need for a highly textured paper product which may maintain a highly textured surface even after becoming wet.

SUMMARY

It has now been discovered that a highly textured tissue product may be produced by providing a tissue web with a plurality of macrofolds. The macrofolds are preferably of varying shapes and sizes. In certain instances, the macrofolded tissue web may be converted into a rolled tissue product comprising a plurality of spaced apart and repeating lines of perforation defining a plurality of sheets therebetween. In certain instances, the product may have a sheet length (L) and a macrofolded ply having an effective machine direction length (MD Length) that is at least about 200 percent of the sheet length (L).

In other embodiments the present invention provides a multi-ply tissue product having distinctly different first and second outer surfaces. The multi-ply tissue product may comprise a plurality of macrofolds in one of the tissue plies, such as a first upper tissue ply. The ply comprising the macrofolds may be attached to a conventional, generally planar, tissue ply to form a dual sided multi-ply tissue product. In certain preferred embodiments the first ply may comprise a plurality of transversely extending, cross-machine direction (CD) orientated, macrofolds. The macrofolded first ply may be attached to a second substantially planar ply by spaced apart, machine direction orientated, points of attachment, such as a pair of crimp lines. In this manner the points of attachment between the first and second plies may be orientated orthogonally to the macrofolds.

The macrofolds, which in certain preferred embodiments are cross-machine direction orientated, may be formed by foreshortening and folding over a tissue ply in the machine direction prior to plying with another tissue ply. In particularly preferred embodiments, the plies are preferably attached to one another orthogonal to the macrofolds. For example, the plies may be attached by crimping the plies along the machine direction orientated with spaced apart crimp lines. In this manner the macrofolds may extend unattached across a portion of the product and form a void that also extends across a portion of the product.

In other embodiments the present invention provides a tissue product having a machine direction (MD) and a cross-machine direction (CD), a first surface and an opposed bottom surface, the product comprising a first substantially planar ply and a second macrofolded ply, a plurality of spaced apart and repeating lines of perforation defining a plurality of sheets having a sheet length (L) therebetween, wherein the first ply has an effective machine direction length (MD Length) that is substantially equal to the sheet length (L) and the second ply has a MD Length that is least about 200 percent of the sheet length (L).

In another embodiment the present invention provides a multi-ply tissue product having a machine direction (MD) and a cross-machine direction (CD), an upper surface and an opposed bottom surface, a first edge and an opposite second edge, the product comprising a first substantially planar ply, the first ply forming the bottom surface; and a second ply comprising a plurality of macrofolds, the second ply forming the upper surface, a pair of substantially MD orientated crimp lines spaced apart from one another in the CD, wherein each of the plurality of macrofolds extend in the CD between the pair of crimp lines and each of the plurality of macrofolds have a MD segment length.

In still other embodiments the present invention provides a method of manufacturing a multi-ply tissue product having a machine direction (MD) and a cross-machine direction (CD), a first outer surface, a second outer surface and a plurality of macrofolds disposed on at least one of its outer surfaces comprising the steps of: (a) conveying a first tissue ply at a first ply speed (S1) through a first nip; (b) conveying the first tissue ply at a second ply speed (S2) through a second nip created by a pair of opposed belts to produce a macrofolded tissue ply; (c) unwinding and conveying a second tissue ply; (d) conveying the macrofolded tissue ply and the second tissue ply through a third nip; and (e) attaching the macrofolded tissue ply and the second tissue ply to one another to form a multi-ply tissue product.

DEFINITIONS

Figure 1:
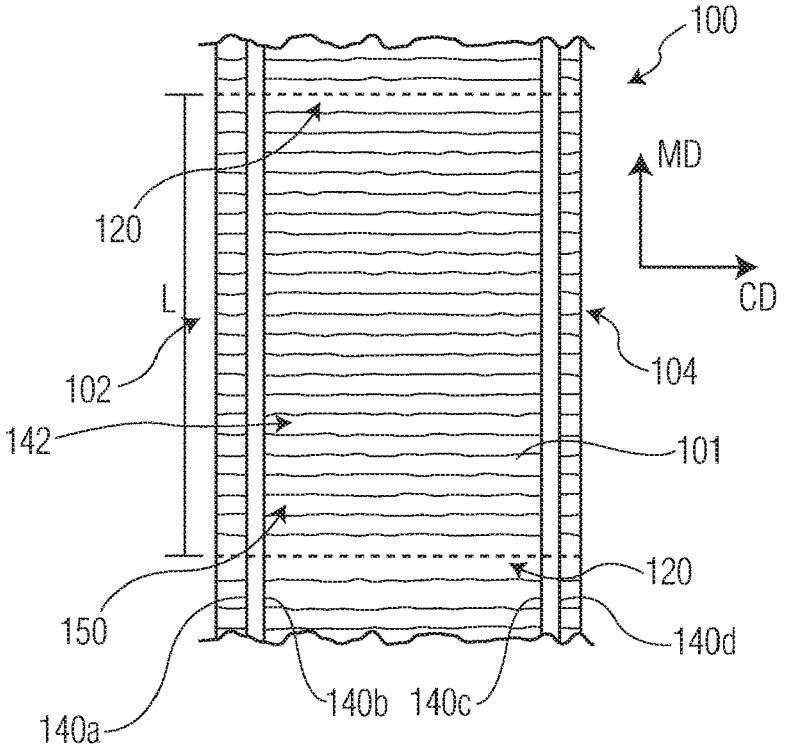
FIG. 1 is a top plan view of a tissue product according to one embodiment of the present invention.

As used herein the term "tissue ply" refers to a structure comprising a plurality of fibers such as, for example, papermaking fibers and more particularly pulp fibers, including both wood and non-wood pulp fibers, and synthetic staple fibers. A non-limiting example of a tissue ply is a wet-laid sheet material comprising pulp fibers having a basis weight from about 10 to about 45 grams per square meter (gsm), such as from about 13 to about 42 gsm and a sheet bulk greater than about 5 cc/g, such as from about 5 to about 12 cc/g.

As used herein, the term "tissue product" refers to products made from one or more tissue plies and include, for example, rolled bath tissue, sheets of facial tissue, paper towels, industrial wipers, foodservice wipers, napkins, and other similar products. In certain preferred embodiments tissue products of the present invention comprise two or more plies, such as two, three or four plies. Each of the plies of a multi-ply tissue product may be substantially identical, or they may be different, such as having been made by a different tissue manufacturing process or possess at least one physical characteristic such as, for example, tensile strength, stretch, basis weight or sheet bulk, that differs.

As used herein, the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "machine direction" of a web, ply, or product is the direction within the plane of web, ply, or product parallel to the principal direction of travel of the structure during manufacture. The cross-machine direction is generally orthogonal the machine direction and lies within the plane of structure. The Z-direction is orthogonal to both the machine direction and cross-machine direction and generally normal to the plane of structure. The machine direction, cross machine direction, and Z-direction form a Cartesian coordinate system.

As used herein, the term "basis weight" generally refers to the bone-dry weight per unit area of a tissue and is generally expressed as grams per square meter (gsm). Basis weight is measured using TAPPI test method T-220.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "sheet bulk" refers to the quotient of the caliper (μm) divided by the bone-dry basis weight (gsm).

As used herein, the terms "geometric mean tensile" (GMT) refers to the square root of the product of the machine direction tensile strength and the cross-machine direction tensile strength of the web.

As used herein the term "line of perforations" generally refers to a line of weakness, such as a plurality of perforations, extending in the transverse cross-machine directional of the web from a first edge to a second edge and providing a means of separating adjacent sheets from one another. The line of perforations may be linear or non-linear.

As used herein the term "sheet" generally refers to a portion of tissue in a rolled tissue product bounded by transverse lines of perforation as is commonly understood in the tissue industry.

As used herein the term "sheet length" generally refers to the distance between a pair of spaced apart transverse lines of perforations defining a sheet. The minimum and maximum sheet lengths are generally determined by the nature of the sheet material product and the needs and preferences of the user. In certain instances, the tissue product may comprise a rolled bath tissue product having a sheet length of about 10 cm centimeters or greater, such as from about 10 to about 15 cm.

As used herein the term "macrofold" generally refers to a macroscopically non-planar portion of a tissue ply. In those embodiments where a macrofolded ply forms part of a rolled tissue product comprising a plurality of sheets, the non-planar nature of the ply causes it to have an effective machine-direction length (MD Length) that exceeds the sheet length (L). Macrofolds are generally the portion of a first macrofolded tissue ply extending between two points of contact with a second ply. For example, with reference to FIG. 2, the second ply 112 comprises a macrofold 150 that extends between first and second points 152 at which the first and second plies 110, 112 contact one another. In certain preferred embodiments a macrofold may have a wave-like shape, having a peak disposed between valleys spaced apart from one another in the machine-direction.

As used herein the term "effective machine direction length" (MD Length) refers to the machine direction length of a ply when the ply is in an extended and tensioned state. The effective machine direction length of a given ply may be measured by first carefully separating a product into individual plies, applying enough tension to make the separated, individual ply, substantially planar and then measure the machine direction length using conventional imaging techniques.

As used herein the term "macrofold segment length" refers to the effective machine direction (MD) length of a macrofold. For example, with reference to FIG. 2, the macrofold 150 has a segment length 180 (shaded portion of first ply 110) that extends in the machine direction (MD) between points of contact 152. The dimensions of the macrofolds may be measured using conventional imaging techniques by inverting the tissue product (where the macrofolds are disposed on an upper surface of the tissue product), apply sufficient tension to make the first ply planar (where the first ply forms the bottom surface of the tissue product and is devoid of macrofolds) and allowing the macrofolds to hang freely.

DETAILED DESCRIPTION

The present invention provides tissue webs or plies comprising a plurality of macrofolds. The macrofolds, which are generally cross-machine direction (CD) orientated, may be formed by foreshortening and folding over a tissue ply in the machine direction prior to plying with another tissue ply. In particularly preferred embodiments, when the macrofolded tissue ply is plied with another tissue ply, the two plies are not attached along the macrofolds. Rather, the plies are preferably attached to one another orthogonal to the macrofolds. In certain instances, the plies are attached by conventional means such as crimping. In this manner the macrofolds may extend unattached across a portion of the cross-machine direction of the product and form a void that also extends across a portion of the cross-machine direction of the product.

Macrofolded tissue webs prepared according to the present disclosure may be combined with conventional, generally planar, tissue webs to form multi-ply tissue products having distinctly different first and second outer surfaces or sides. The two-sidedness is generally provided by forming one of the surfaces from a tissue ply, such as a first upper tissue ply, from a macrofolded tissue ply and the other side from a substantially planar tissue ply. For example, the first ply may comprise a plurality of transverse, cross-machine direction (CD) orientated macrofolds attached to a second substantially planar tissue ply by machine direction orientated attachment means. The macrofolds may form a wave-like structure having an amplitude and wavelength and a transversely orientated void. The combination of these elements provides a tissue product that is both aesthetically pleasing and particularly well suited to cleaning due to the large amount of surface area created by the macrofolds.

The multi-ply tissue products of the present invention generally comprise two, three or four tissue plies made by well-known wet-laid papermaking processes such as, for example, creped wet pressed, modified wet pressed, creped through-air dried (CTAD) or uncreped through-air dried (UCTAD). For example, creped tissue webs may be formed using either a wet pressed or modified wet pressed process such as those disclosed in U.S. Pat. Nos. 3,953,638, 5,324,575 and 6,080,279, the disclosures of which are incorporated herein in a manner consistent with the instant application. In these processes the embryonic tissue web is transferred to a Yankee dryer, which completes the drying process, and then creped from the Yankee surface using a doctor blade or other suitable device.

In other instances, the tissue plies by a through-air dried process known in the art. In such processes the embryonic web is noncompressively dried. For example, textured tissue plies may be formed by either creped or uncreped through-air dried processes. Particularly preferred are uncreped through-air dried webs, such as those described in U.S. Pat. No. 5,779,860, the contents of which are incorporated herein in a manner consistent with the present disclosure.

In still other instances the tissue plies may be manufactured by a process including the step of using pressure, vacuum, or air flow through the wet web (or a combination of these) to conform the wet web into a shaped fabric and subsequently drying the shaped sheet using a Yankee dryer, or series of steam heated dryers, or some other means, including but not limited to tissue made using the ATMOS process developed by Voith or the NTT process developed by Metso; or fabric creped tissue, made using a process including the step of transferring the wet web from a carrying surface (belt, fabric, felt, or roll) moving at one speed to a fabric moving at a slower speed (at least 5 percent slower) and subsequently drying the sheet. Those skilled in the art will recognize that these processes are not mutually exclusive, e.g., an uncreped TAD process may include a fabric crepe step.

The instant multi-ply tissue product may be constructed from two or more plies that are manufactured using the same or different tissue making techniques. In a particularly preferred embodiment, the multi-ply tissue product comprises two or more plies, such as two, three or four plies where each of the plies comprise a wet-pressed tissue ply, where each ply has a basis weight greater than about 10 gsm, such as from about 10 to about 45 gsm, such as from about 10 to about 42 gsm. In a particularly preferred embodiment, each of the plies have substantially similar basis weights and the upper most ply comprises a plurality of macrofolds.

Regardless of the tissue making process used to produce the individual plies, the resulting multi-ply tissue product comprises at least one macrofolded ply, which in certain preferred instances forms at least one of the outer surfaces of the product. For example, in one embodiment, such as that illustrated in FIG. 1, the tissue product 100 has an upper surface 101 having a plurality of macrofolds 150. In the illustrated embodiment the macrofolds 150 extend transversely in the cross-machine direction (CD) from a first edge 102 to a second edge 104 of the tissue product 100.

With continued reference to FIG. 1, the tissue product 100 may further comprise spaced apart lines of perforations 120 that define individual tissue sheets 142, therebetween. The individual tissue sheets 142 have a machine direction length, generally referred to herein as a sheet length (L).

The tissue product 100 further comprises spaced apart, substantially MD orientated, crimp lines 140*a*-140*d*. The crimp lines 140 are provided to attach multiple plies together to form the product 100.

The crimp lines 140 may be disposed adjacent to the first and second edges 102, 104 and may extend continuously in the MD.

While the product of FIG. 1 is illustrated as having plies attached by crimp lines, the invention is not so limited. The individual plies of a multi-ply tissue product may be joined together using any ply attachment means known in the art, such as mechanical crimping, adhesive, or embossing. For example, in one embodiment, the plies may be attached by a MD orientated adhesive that extends the length of the ply, such as described in U.S. Publ. No. 2014/0127479A1, the contents of which are incorporated herein in a manner consistent with the present invention. In other embodiments the plies may be attached by crimping, such as described in U.S. Publ. No. 2005/0224201A1, the contents of which are incorporated herein in a manner consistent with the present invention.

Crimping is a particularly preferred ply attachment means as it avoids the over stiffening of the tissue product often associated with adhesive ply attachment and does not impart any additional texture to the product as is often the case with embossing. For example, as illustrated in FIG. 1, the tissue product 100 comprises spaced apart, substantially MD orientated crimp lines 140*a*-140*d*, which are spaced apart from one another in the CD.

Figure 2:
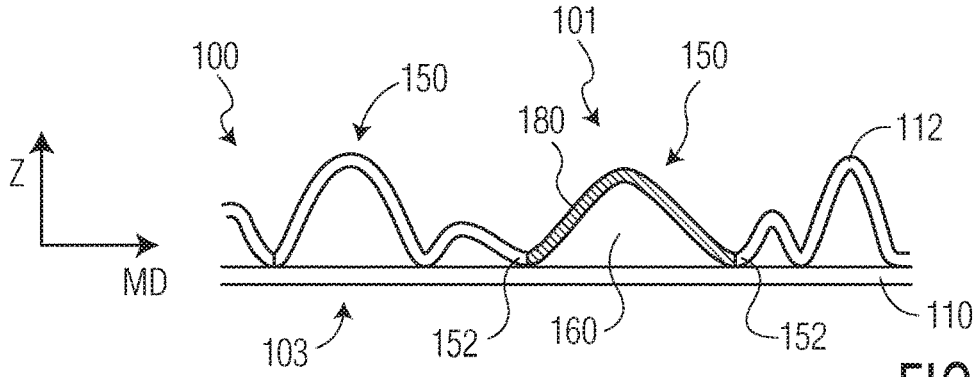
FIG. 2 is a cross-sectional view of a tissue product according to one embodiment of the present invention.

With reference now to FIG. 2, the tissue product 100 may comprise first and second tissue plies 110, 112. The first tissue ply 110, also referred to as the bottom ply, forms the bottom surface 103. The second tissue ply 112, also referred to as the upper ply, forms the upper surface 101. The first ply 110 is substantially planar and in certain instances may comprise a plurality of embossments. The second ply 112 comprises a plurality of macrofolds 150. Each macrofold 150 generally extends between first and second points of contact 152 between the first and second plies 110, 112.

In certain embodiments the macrofolds may generally have a wave-like shape with troughs or valleys spaced apart from one another in the MD and lying on either side of a peak. While macrofolds may have a wave-like shape, the size of individual macrofolds may vary. For example, the macrofolds 150 may have different macrofold segment lengths 180 (shaded portion of first ply 110). In certain embodiments the macrofold segment length may range from about 1.5 to about 12 mm, such as from about 2.0 to about 10 mm, such as from about 2.0 to about 8.0 mm.

The dimensions of the macrofolds may be measured using conventional imaging techniques by inverting the tissue product (where the macrofolds are disposed on an upper surface of the tissue product), apply sufficient tension to make the first ply planar (where the first ply forms the bottom surface of the tissue product and is devoid of macrofolds) and allowing the macrofolds to hang freely.

In certain preferred embodiments, unlike the second macrofolded ply, the first ply may be substantially planar. In this manner the first ply may have an effective machine direction length (MD Length) that is substantially equal to the sheet length (L). Although it is generally preferred that the first ply be planar, the ply may possess texture or topography that may be non-planar on the microscale. For example, the first play may be macroscopically planar despite having a plurality of embossments or having a textured surface as the result of having been formed by wet molding. Unlike the first ply, the second, upper, ply comprises a plurality of macrofolds.

The difference in structure between various plies of the product generally results in the plies having different effective machine direction lengths (MD Lengths). For example, in one embodiment, the invention provides a rolled multi-ply tissue product comprising a plurality of sheets having a sheet length (L), wherein the presence of macrofolds provide one of the plies with an effective machine direction length that is at least about 200 percent of the sheet length (L). In other embodiments, the macrofolded ply may have an effective machine direction length (MD Length) that is from about 200 to about 800 percent of the sheet length (L), such as from about 300 to about 700 percent of the sheet length (L), such as from about 400 to about 600 percent of the sheet length (L).

In other instance, the difference in structure of two or more plies causes the plies to have different machine direction lengths relative to one another. For example, a tissue product may comprise a macrofolded upper ply having an effective machine direction length (MD Length) that is at least about 200 percent of the MD Length of a planar bottom ply. In other embodiments, the MD Length of the macrofolded ply may be from about 200 to about 800 percent of the MD Length of the planar ply, such as from about 300 to about 700 percent of the planar ply MD Length, such as from about 400 to about 600 percent of the planar ply MD Length.

The effective machine direction length (MD Length) of a given ply may be measured by separating a sheet from an adjacent sheet along the line of perforations. The separated sheet may then be further separated into individual plies by gently lifting on the upper most ply, generally the ply comprising macros-folds, to separate the plies from one another, taking care not to tear the plies. Once separated into individual plies, the plies are flattened by applying a slight tension to the ends of the plies, which may be accomplished by simply using one's hands to extend the plies, and the MD Length is measured using conventional means.

Figure 3:
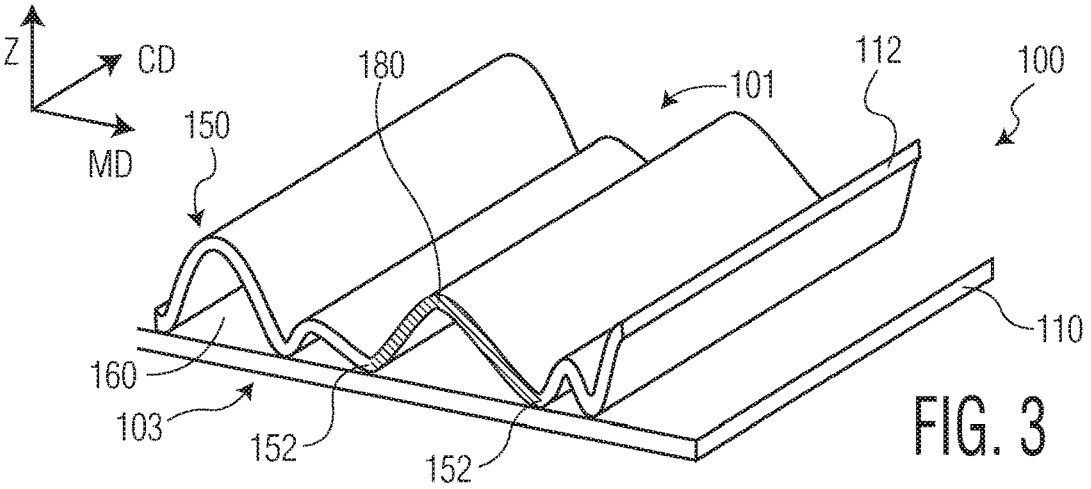
FIG. 3 is a perspective view of a tissue product according to one embodiment of the present invention.

With continued reference to FIGS. 2 and 3, the macrofolds 150 may define a void 160 extending transversely in the cross-machine direction (CD). In a particularly preferred embodiment, the void extends continuously between points of attachment between the first and second plies, such as a pair of spaced apart crimp lines (illustrated in FIG. 1). In those instances where each of the plurality of macrofolds has a substantially different shape and/or size, the voids defined thereby will also be similarly differently shaped and/or sized.

In certain embodiments one or more of the outer most plies of the tissue product may comprise a plurality of embossments. In one preferred embodiment the first ply, which generally forms the bottom surface of the tissue product, may have a total embossed area from about 5 percent to about 40 percent, more preferably ranging from about 8 percent to about 35 percent, even more preferably ranging from about 20 percent to about 25 percent. In a preferred embodiment, only embossed elements that are completely disposed upon the tissue sheet surface are utilized for the calculation of total embossment footprint area. However, one of skill in the art would be able to utilize such fractional portions of embossed elements in accordance with the present invention to determine the appropriate relationship of total embossment footprint area to total surface are of a tissue sheet surface area.

Figure 4:
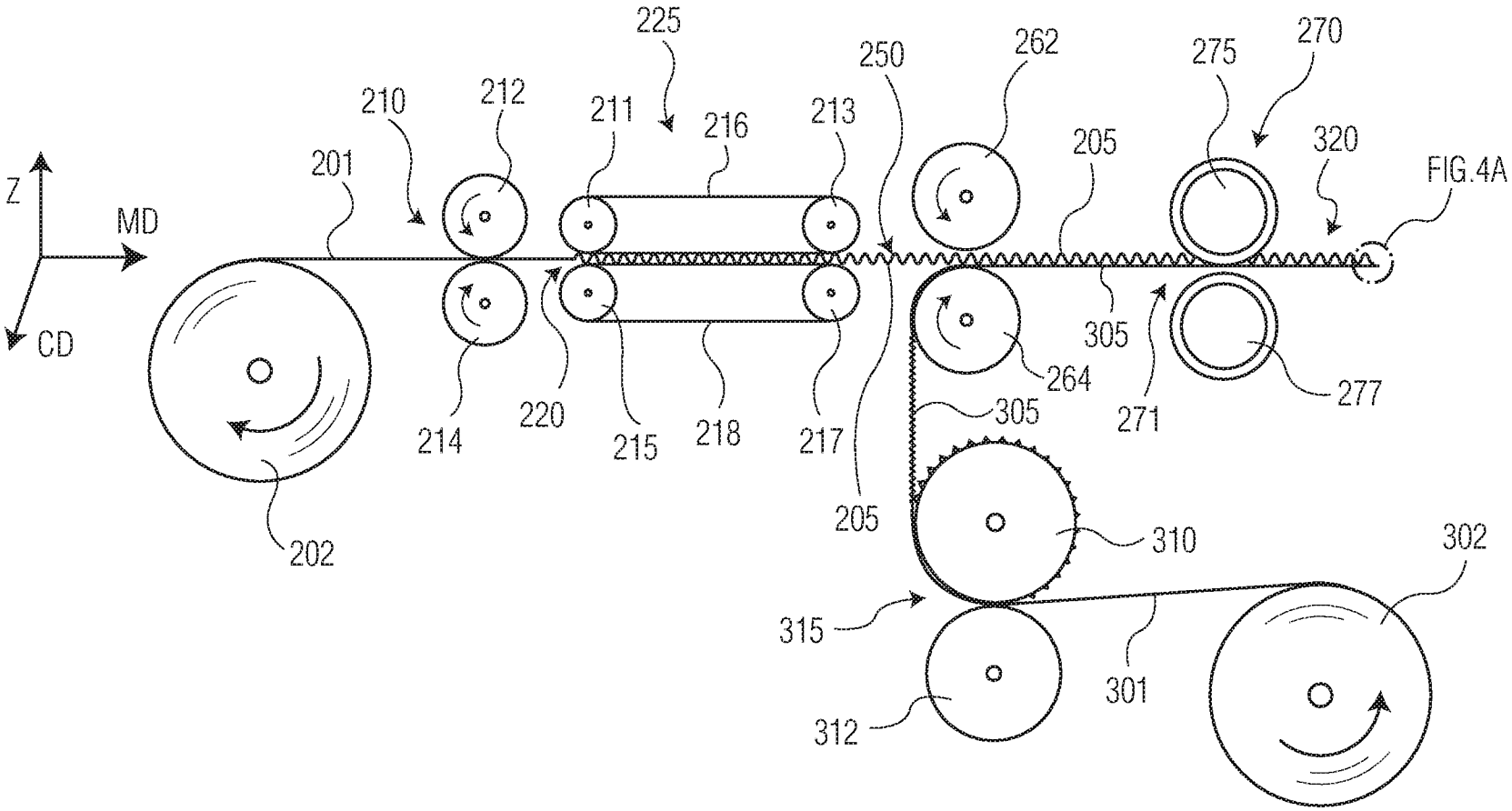
FIG. 4 is a schematic view of a process for manufacturing a tissue product according to one embodiment of the present invention.
Figure 5:
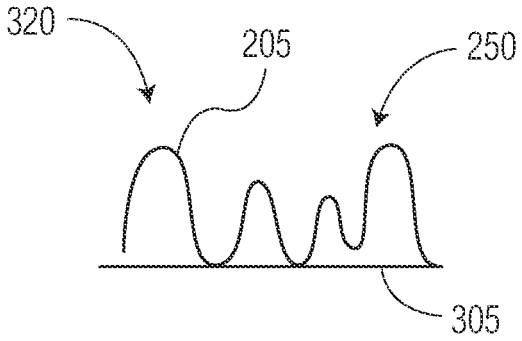
FIG. 5 is a perspective of an apparatus useful in forming a macrofolded tissue ply according to the present invention.

The tissue products of the present invention may be manufactured by a process whereby the top ply is deformed to form a plurality of macrofolds and then combined with a substantially planar ply. One suitable process is illustrated in FIG. 4. As shown in FIG. 4, a first tissue ply 201, which will form the uppermost ply of the finished tissue product, is unwound from a first parent roll 202 towards a pair of opposed rolls 212, 214. The first and second rolls 212, 214 are proximally positioned relative to each other to provide an operative nip region 210 therebetween.

One or both of the first and second rolls 212, 214 may be driven to move the first ply 201 at a first linear web speed (S1) through the nip 210. While in the illustrated embodiment the first web speed (S1) is controlled by a pair of opposed rolls creating a nip, it will be appreciated by one skilled in the art that other means may be employed to move the first ply through the apparatus at the desired first linear web speed (S1). Accordingly, any operative transport mechanism or system may be employed to move the first ply through the method and apparatus at the desired first linear web speed (S1). Suitable transport or delivery systems include, for example, roller systems, belt systems, pneumatic systems, or conveyors, and the like.

The first ply 201, which is held in the nip 210 of the opposed rolls 212, 214, extends into a second nip 220 formed between a pair of opposed belts 216, 218. The opposed belts 216, 218, which are arranged in facing relationship to one another, and their associated support and drive mechanisms comprise a macrofold station 225. With the first ply 201 gripped in the second nip 220 formed by the pair of opposed belts 216, 218 the speed of the opposed belts 216, 218 is adjusted slightly from the first web speed (S1) to provide the first ply 201 with a second linear web speed (S2) at the second nip 220. In this manner, the speed differential between the first and second nips 210, 220 exerts a slight retarding force on the first ply 201 relative to the propelling force of the first and second rolls 212, 214. This difference between S1 and S2 results in the formation of macrofolds 250.

The illustrated opposed belts 216, 218 are trained about and driven by drive rolls 211, 215 at their forward ends and are trained about suitable idler rolls 213, 217 at their rearward ends. The drive rolls may be driven by any well-known means in the art such as, for example, a driving shaft exuding from the drive rolls to a common gear box which is driven by an input shaft from a suitable source of driving power, such as a motor. Preferably the drive rolls are driven such that the speed of the drive rolls may be varied which, in turn, varies the linear speed of the belts engaging the first ply.

Generally, the portions of the first ply 201 within the second nip 220 formed between the belts 216, 218 travels at the linear speed of the belts 216, 218. In this manner the nominal linear speed of the first ply 201 within the second nip 220 may have a second nominal linear speed (S2). In particularly preferred embodiments there is a non-zero speed differential between S1 and S2. In certain embodiments S1 is greater than S2, such as from about 2 to about 30 percent greater, such as from about 2 to about 20 percent greater. Generally, the speed differential causes the first ply to slide and bunch between the belts creating a plurality of macrofolds.

It will be appreciated that the change of ply tension at the macrofolding station will cause a change in ply tension of those stations immediately upstream of it. More specifically, the changing of the belt speed within the macrofolding station also effects the tension of the ply immediately upstream of it since its speed is now changed relative to the upstream feeding speed. For example, slowing down the linear speed of the belts at the macrofolding station will cause a ply accumulation at the entrance to its nip due to the ply issuing at a rate from the adjacent upstream section that is greater than the rate it is being accepted. By controlling ply tension between adjacent stations, the degree of macrofolding provided by the macrofolding station may be controlled.

Generally, it is preferred that the second nip 220 be relatively low pressure to permit the formation of macrofolds 250 in the upper most ply 205 of the finished tissue product 320 (shown in detail in FIG. 4A). To achieve the desire pressure, the facing runs of the belts 216, 218 may be spaced apart by a distance greater than the first ply 201 thickness at the upstream mouth of the belts. In a particularly preferred embodiment, the facing runs of the belts may be spaced apart at least about 1.0 mm, such as from about 1.0 to about 10.0 mm, such as from about 2.0 to about 6.0 mm. In certain preferred embodiments the facing runs of the belts are substantially parallel to one another along their entire length and the distance between the belts is substantially equal.

In other embodiments, it may be preferred, for the purpose of providing a low pressure nip and easy entry for the first ply between the opposed belts that the facing runs of the belts be spaced apart by a distance greater than the first ply thickness at the upstream mouth for the belts and then converge slightly in the downstream direction to grip the first ply. Further, to provide a low-pressure grip, facing runs may be backed by a series of rollers rotatably mounted on shafts journaled in longitudinally extending side frames.

To help provide desired speed data; e.g. data regarding the speed of opposed rolls forming the first nip, speed of the rotating opposed belts and/or linear speed of the ply; the method and apparatus can include operative speed sensors. Such speed sensors are conventional and available from commercial vendors. Suitable speed sensors can, for example, include tachometers, doppler speed sensors, laser-Doppler speed sensors, or the like, as well as combinations thereof.

Further, the method and apparatus may include position control systems, which are well known in the motion control industry. At some periodic rate, a motion profile generator injects a desired position into a summing junction, also referred to herein as a comparator. Actual position is subtracted from the desired position to provide a position error. This error is injected into a digital filter that outputs a DAC (digital to analog converter) value.

The DAC value is scaled accordingly to match the inputs and outputs of the power stage or amplifier, which converts this input signal and outputs a winding current that is proportional to the input signal. With new components, the digital filter may output a digital value whereby the power stage can accept this digital value and accomplish the same as the analog version. Winding current is delivered to the motor and is typically proportional to the motor output torque. This ultimately provides motion to the mechanism. An encoder or other suitable feedback device located on the motor or on the mechanism provides the actual position back to the summing junction, completing the outer closed loop. (The control loop within the power stage that regulates output current is commonly referred to as an inner loop.)

In other embodiments the method and apparatus can have a configuration in which the computer or other control system has been operatively directed to coordinate the first linear web speed (S1) and the second linear web speed (S2) to thereby modify or change the shape and/or frequency of the macrofolds. In a desired configuration the computer can be reprogrammed or otherwise electronically directed to appropriately coordinate the first and second linear web speeds, S1 and S2, to provide the desired change in macrofolds, such as the shape and/or frequency of the macrofolds.

To form a two-ply tissue product, a second parent roll 302 is unwound and a second tissue ply 301 is conveyed into an embossing nip 315 formed between an impression roll 312 and an engraved embossing roll 310. The impression roll generally has a smooth outer surface, which may be deformable. In certain instances, the impression roll has an outer covering comprising a natural or synthetic rubber and may have a hardness greater than about 40 shore (A), such as from about 40 to about 100 shore (A). The engraved embossing roll generally comprises a plurality of protuberances extending from its peripheral surface. In one embodiment the protuberances may comprise a plurality of discrete dot elements and form an embossing pattern. In certain embodiments the protuberances disposed on the engraved embossing roll may have a height of at least about 0.2 mm, such as from about 0.2 to about 3.0 mm.

As the second ply 301 passes through the embossing nip 315 it is imparted with a plurality of embossments, which may be arranged to form an embossing pattern. The embossed second ply 305 is then conveyed and brought into facing relation with the macrofolded first ply 205 by passing the plies 205, 305 between a pair of opposed rolls 262, 264. While in certain instances the engraved embossing roll 310 and impression roll 312 may be arranged relatively close to the pair of rolls 262, 264 this is not necessary because the present method does not rely upon registration of the macrofolds 250 disposed on the first ply 205 and the embossments on the second ply 305.

With continued reference to FIG. 4, in certain embodiments, after being brought into facing arrangement between the pair of opposed rolls 262, 264 the first and second plies 205, 305 encounter a crimping apparatus 270. The crimping apparatus 270 includes an anvil roll 275 and a crimping roll 277 that may include one or more protuberances for deforming and attaching the plies to one another. The anvil roll 275 and the crimping roll 277 are loaded together by appropriate means (not shown) to create a nip 271. To crimp the multi-ply web, the multi-ply web is fed into the nip 271 while the anvil roll 275 and crimping roll 277 are rotated. The crimped multi-ply web 320 is then removed from the nip 271 and subjected to further processing to create a rolled tissue product.

The materials used to make the crimping roll and the anvil roll can be any suitable material that can withstand the high nip loads. Crimping rolls can be made of CPM-10V steel hardened to a Rockwell C hardness of approximately 60-62. Anvil rolls can be made from 52100 quench and tempered steel, hardened to a Rockwell C hardness of approximately 62-64 for a depth of approximately 5 mm.

The loading pressure in the crimping nip in pounds per square inch (psi) for the protuberances against the anvil roll should be sufficient to crush and deform the multi-ply web in order to form the crimping bond depressions. In various embodiments of the invention, the loading pressure can be between about 25,000 psi to about 250,000 psi, between about 50,000 psi to about 200,000 psi, or between about 75,000 psi to about 150,000 psi.

In other embodiments the foregoing process may be adapted to produce a single ply tissue product having a plurality of macrofolds. For example, a single ply web may be unwound and passed through a first nip to provide the web with a first linear web speed. The web may then be conveyed to a macrofolding station comprising a pair of opposed belts as described above. Upon entering a second nip created by the opposed belts of the macrofolding station the web may have a second linear web speed to provide the web with a plurality of macrofolds. The macrofolded single ply web may then be subjected to further converting to produce a macrofolded single ply tissue product.

The tissue products of the present invention may have a basis weight from about 20 to about 120 gsm, such as from about 30 to about 90 gsm, such as from about 42 to about 80 gsm. In certain instances, the tissue product may comprise one or more plies. In particularly preferred embodiments the tissue products are multi-ply embossed tissue products and comprise two, three or four tissue plies where the basis weight of each individual tissue ply is less than about 25 gsm, such as from about 10 to about 20 gsm, such as from about 10 to about 15 gsm. In certain instances, the present invention provides a multi-ply tissue product comprising a first macrofolded tissue ply having a basis weight from about 10 to about 45 gsm and a second embossed tissue ply having a basis weight from about 10 to about 30 gsm.

In other embodiments, the products of the present invention may have a geometric mean tensile (GMT) strength from about 800 to about 1,800 g/3", such as from about 800 to about 1,600 g/3", such as from about 800 to about 1,500 g/3". In a particularly preferred embodiment, the invention provides a tissue product comprising a first macrofolded ply and a second embossed ply, the product having a GMT from about 800 to about 1,800 g/3", such as from about 800 to about 1,600 g/3", such as from about 800 to about 1,500 g/3" and a basis weight from about from about 30 to about 65 gsm, such as from about 42 to about 60 gsm.

What is claimed is:

1. A tissue product having a machine direction (MD) and a cross-machine direction (CD), a first upper surface and an opposed bottom surface, the product comprising:

a first tissue ply having a basis weight from about 10 to about 60 gsm and a sheet bulk greater than about 5 cc/g and a first effective machine direction length (MD Length);

a second tissue ply having a basis weight from about 10 to about 60 gsm and a sheet bulk greater than about 5 cc/g, a plurality of macrofolds and a second MD Length; and a plurality of perforations spaced apart from one another in the MD and defining a plurality of sheets having a sheet length (L) therebetween;

wherein the first MD Length is substantially equal to the sheet length (L) and the second MD Length is at least about 200 percent of the sheet length (L).

2. The tissue product of claim 1 wherein the first ply is substantially planar.

3. The tissue product of claim 1 wherein the first ply is embossed.

4. The tissue product of claim 1 further comprising first and second points of attachment between the first and second plies.

5. The tissue product of claim 4 wherein the points of attachment are linear and substantially MD orientated.

6. The tissue product of claim 5 wherein the points of attachment comprise a pair of crimp lines spaced apart from one another in the CD.

7. The tissue product of claim 1 wherein each of the plurality of macrofolds have a different shape or macrofold segment length.

8. The tissue product of claim 1 wherein each of the plurality of macrofolds extend transversely in the CD direction.

9. The tissue product of claim 8 wherein at least a portion of the plurality of macrofolds are unattached to the first ply.

10. The tissue product of claim 1 wherein the second MD Length is from about 200 to about 800 percent of the sheet length (L).

* * * * *